US006977567B2

(12) United States Patent
Li et al.

(10) Patent No.: US 6,977,567 B2
(45) Date of Patent: Dec. 20, 2005

(54) LOW-VOLTAGE CIRCUIT BREAKER WITH A CAPABILITY OF TRIPPING QUICKLY

(75) Inventors: Ran Li, Yueqing (CN); Yuming Duan, Yueqing (CN); Guangshu Zheng, Yueqing (CN); Talyu Wang, Yueqing (CN)

(73) Assignee: Zhejiang Chint Electrics Co. Ltd., Zhejiang (CH)

( * ) Notice: Subject to any disclaimer, the term of this patent is extended or adjusted under 35 U.S.C. 154(b) by 0 days.

(21) Appl. No.: 11/075,964

(22) Filed: Mar. 10, 2005

(65) Prior Publication Data

US 2005/0151607 A1 Jul. 14, 2005

Related U.S. Application Data

(63) Continuation of application No. PCT/CN03/00198, filed on Mar. 19, 2003.

(30) Foreign Application Priority Data

Sep. 12, 2002 (CN) ..... 02136986 A

(51) Int. Cl.[7] ..... H01H 75/00

(52) U.S. Cl. ..... 335/6; 335/21; 335/23; 335/35; 335/201

(58) Field of Search ..... 335/6–16, 21, 335/23, 35, 201

(56) References Cited

U.S. PATENT DOCUMENTS

| | | | | |
|---|---|---|---|---|
| 4,430,631 | A | 2/1984 | Forsell et al. | |
| 4,521,756 | A | 6/1985 | Forsell | |
| 5,103,198 | A * | 4/1992 | Morel et al. | 335/6 |

FOREIGN PATENT DOCUMENTS

| | | |
|---|---|---|
| CN | A-1056374 | 11/1991 |
| CN | ZL-92111503.2 | 12/1998 |
| JP | A-9320442 | 12/1997 |

* cited by examiner

*Primary Examiner*—Ramon M. Barrera
(74) *Attorney, Agent, or Firm*—Jacobson Holman PLLC

(57) ABSTRACT

This invention discloses a low-voltage circuit breaker with a capability of tripping quickly. Its main feature is that at least one of the side faces of the contact device provides an open flange which has an internal through hole, and the bottom of a rotating shaft disposed on the bottom part provides a stressed member. The stressed member receives the over-pressure airflow escaping from the open flange of the contact device to generate a force. The force is passed to the activating member by the rotating shaft and is magnified, then hits the latch quickly and makes a trip. An intermediate step is bypassed due to the force produced earlier, the force which is produced by the electromagnetism part in the heat energy and electromagnetic system, so that the low-voltage breaker can open quickly and reduces opening time greatly and improve the breaking capability.

7 Claims, 10 Drawing Sheets

LOW-VOLTAGE CIRCUIT BREAKER WITH A CAPABILITY OF TRIPPING QUICKLY

This is a continuation of PCT/CN03/000198 filed Mar. 19, 2003 and published in Chinese.

FIELD OF THE INVENTION

This invention relates to a low-voltage circuit breaker with one-pole or multi-pole, particularly to a low-voltage circuit breaker with a capability of tripping quickly.

DESCRIPTION OF THE RELATED ART

The conventional low-voltage circuit breaker includes a one-pole or multi-pole contact device, an operating mechanism that can open or close the brake, the heat energy and electromagnetic tripper that can take action when an overloading and/or short-circuit occurs, and a bottom part, a base part and a casing which receive the contact device, the operating mechanism and the tripper. As is well known, when a circuit breaker is overloaded with high volume of current, the contact heads of the contact device would be affected by the electrical dynamic to repulse each other so that the current is limited, then the electromagnetic part of the heat energy and electromagnetic tripper is actuated to quickly switch off the breaker and to protect the power line and the equipment. In multi-pole circuit breakers, each pole may be impacted by the short-circuit current, so it is necessary for each of them to have a capability of current-limiting and electromagnetically disconnecting the circuit quickly. However, the conventional breaker can not switch quickly only by mutual repulsion of the contact heads in the contact system to limit the current and by the action of the electromagnetic part of the heat energy and electromagnetic tripper for disconnection, and always causes the disconnection capability of the breaker for short circuit to reach saturation, thus it is difficult to enhance the switching capability.

A patent with the number ZL92111503.2 in China provides a low-voltage circuit breaker with rapid disconnection capability, which uses the gas chamber to collect the high pressure gas generated by disconnecting the current with contact heads, and to push the piston and drive the lever to hit the latch and disintegrate the four-lever structure of the operating mechanism in the breaker so as to disconnect the switch rapidly. However, its structure and technique is complex and its production cost is high.

SUMMARY OF THE INVENTION

Accordingly, an objective of the present invention is to provide a low-voltage circuit breaker with a capability of tripping quickly to solve the problems in a conventional breaker, namely, that the breaking protection capability tends to saturate and the breaking capability is hard to enhance.

In order to accomplish the above objective, the present invention provides a simple and effective solution: a circuit breaker comprising a housing with a bottom part, a base part and a casing; a one-pole or multi-pole contact device, an arc-extinguishing chamber with arc-extinguishing grid disposed in the contact device, the contact heads disposed in the arc-extinguishing chamber can be disconnected under the force of electrical repulsion generated when the current exceeds a certain value, thus limiting can limit the current; an operating mechanism that can open and close the contact heads and, a heat energy and electromagnetic tripper and a rotating shaft that can drive the operating mechanism in case of over loading and/or short-circuits occurs; wherein at least one of the side surfaces of the contact device provides an open flange that is communicated to a chamber wherein high-pressure gas is produced and stored; and the rotating shaft is disposed on a corresponding location of the bottom base. The rotating shaft includes a stressed member mating with the open flange and an activating member to actuate the tripper of the operating mechanism to disconnect the switch with torsion passed by the stressed member. The activating member is disposed corresponding to the latch.

When the low-voltage circuit breaker is impacted by a high volume current, the contact heads are disconnected by the repulsive force, to produce electric arc, and then to generate energy and impact, wherein most of the energy and impact are consumed by the arc-extinguishing grids, some of the energy and impact escape along the open flange of the contact device. The stressed members receive the overpressure airflow that flows from the open flange of the contact device. In this way, a rotating force around the rotating shift is produced. The rotating force is passed to and magnified by the activating member, then the activating member hits the latch quickly and makes a trip. Because the rotating force is produced earlier than the force which is produced by the heat energy tripper and the electromagnetic part in the electromagnetic system, and the intermediate step in which an electromagnetic force hits the tripping device by the adjusting lever and the bounce latch is eliminated, the low-voltage breaker can break the circuit early so as to reduce breaking time and greatly improve breaking capability. By theoretical analysis, this multi-pole low-voltage circuit breaker of the present invention can improve the breaking capability of the conventional breaker by 50%, which has been confirmed by experiment.

The lower end of the rotating shaft is disposed on a first support member on the bottom part and the upper end is pivoted on a second support member. The second support member is mechanically connected to the bottom part to keep the rotating shaft rotating flexibly.

A floating sensor member is jacketed within the open flange of the contact device. There is a travel clearance in the axial direction between the sensor member and the open flange; the stressed member is in a wing-shape and its stressed surface is perpendicular to the axis of the open flange. The sensor member receives the airflow escaping from the open flange of the contact device and flows out, hitting the rotating wing-shape pieces, which produces a rotating force around the rotating shaft. This rotating force is passed on to the activating member and magnified, then the activating member hits the latch quickly and makes a trip. The angle of rotation for the rotating shaft is confined by the location of its installation between the wing-shaped pieces and the contact device. The sensor member is confined within the open flange after finishing its working travel to keep the gas in the contact device from leaking. The exterior surface of the open flange is in a cone-shape, such shape cannot only ensure the strength of the flange, but also save material.

As another embodiment of this invention, the exterior surface of the open flange is in cylindrical shape; the stressed member is in a cup-shape and mated with the open flange, and the mating distance between them is longer than the travel of the stressed member. If the rotating shaft rotates under a heavy airflow, the cup-shaped stressed member should not disengage from the open flange of the contact device. This prevent the gas from circulating between the adjacent contact devices to induce short circuit or the gas of one single pole escape to destroy the bottom part, the base part and the casing, etc.

The rotating shaft, the activating member and the stressed member can be designed into an integrated structure or a structure with parts that could be assembled. The former structure has higher rigidity and easy to produce. This mechanism is arranged between the adjacent contact devices or on one side of one single pole. The lower end and the middle parts of the rotating shaft have support to keep it rotating smoothly and quickly. The rotating shaft has a return spring that can move back quickly when the gas-flow hits the latch and make a trip so as to implement the next over-loading interruption. The spring can be a torsion spring, a pulling spring or a press spring. In a low-voltage circuit breaker, a single rotating shaft may be arranged for a single pole breaker. For a multi-pole breaker, in order to improve the interrupting capability for each pole, such quick trip mechanism should also be arranged between every two adjacent pole contact devices, so that when the number of the pole of the multi-pole breaker is n, the number of the quick trip mechanism is n-1. Therefore, each quick trip mechanism can drive the tripper to make a trip, and achieve the purpose of allowing the low-voltage circuit breaker to break quickly and to protect the circuit and the equipment.

In the multi-pole breaker, the stressed member of the rotating-hit quick trip mechanism is, preferably, a pair, facing toward the open flange of the adjacent contact device, respectively.

BRIEF DESCRIPTION OF THE DRAWINGS

Hereinafter, the present invention will be described with reference to the accompanying drawings and embodiments.

DETAILED DESCRIPTION OF THE INVENTION

Figure 1:
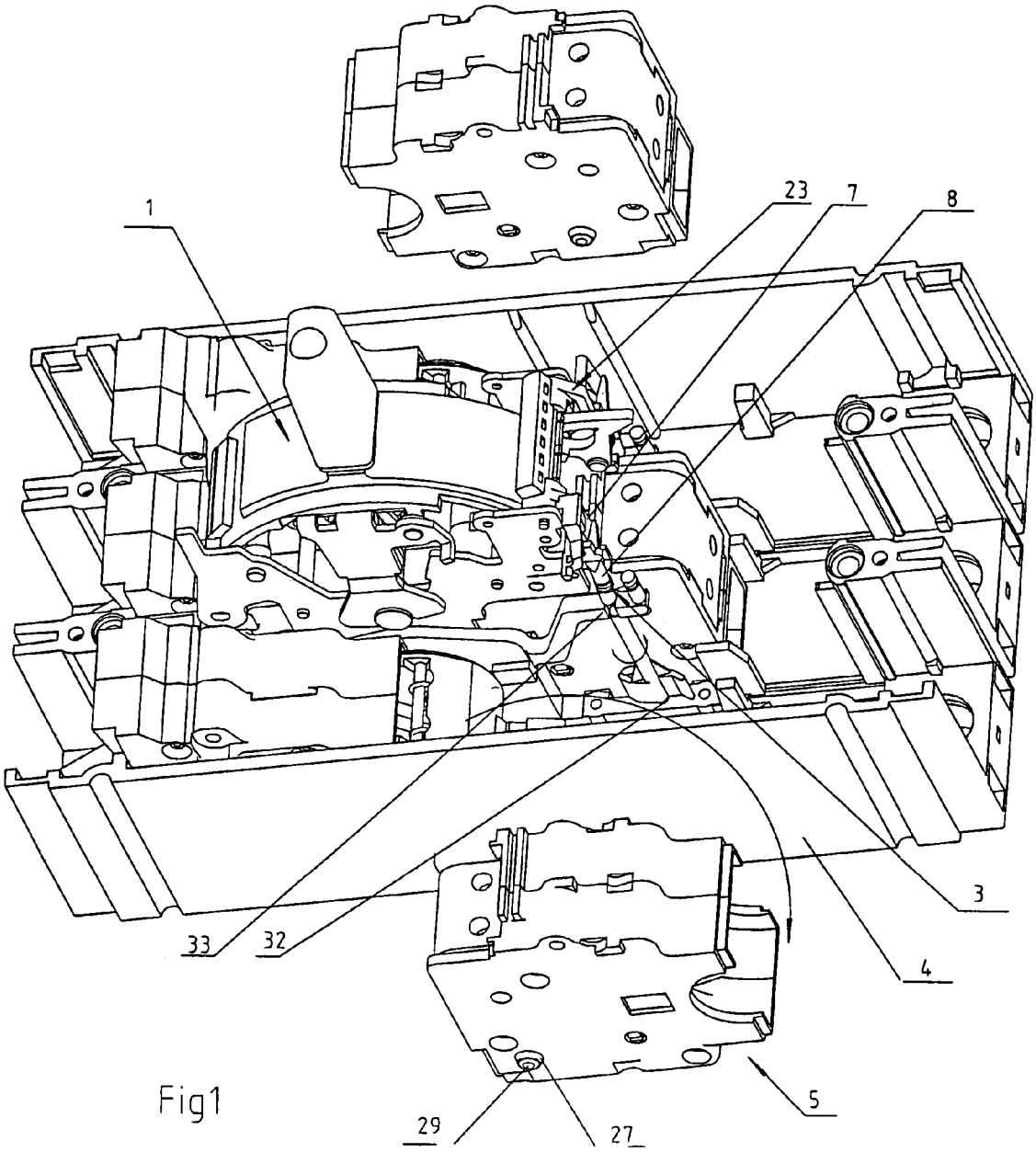
FIG. 1 is a structural schematic view of an embodiment of a low-voltage circuit breaker of the present invention.
Figure 2:
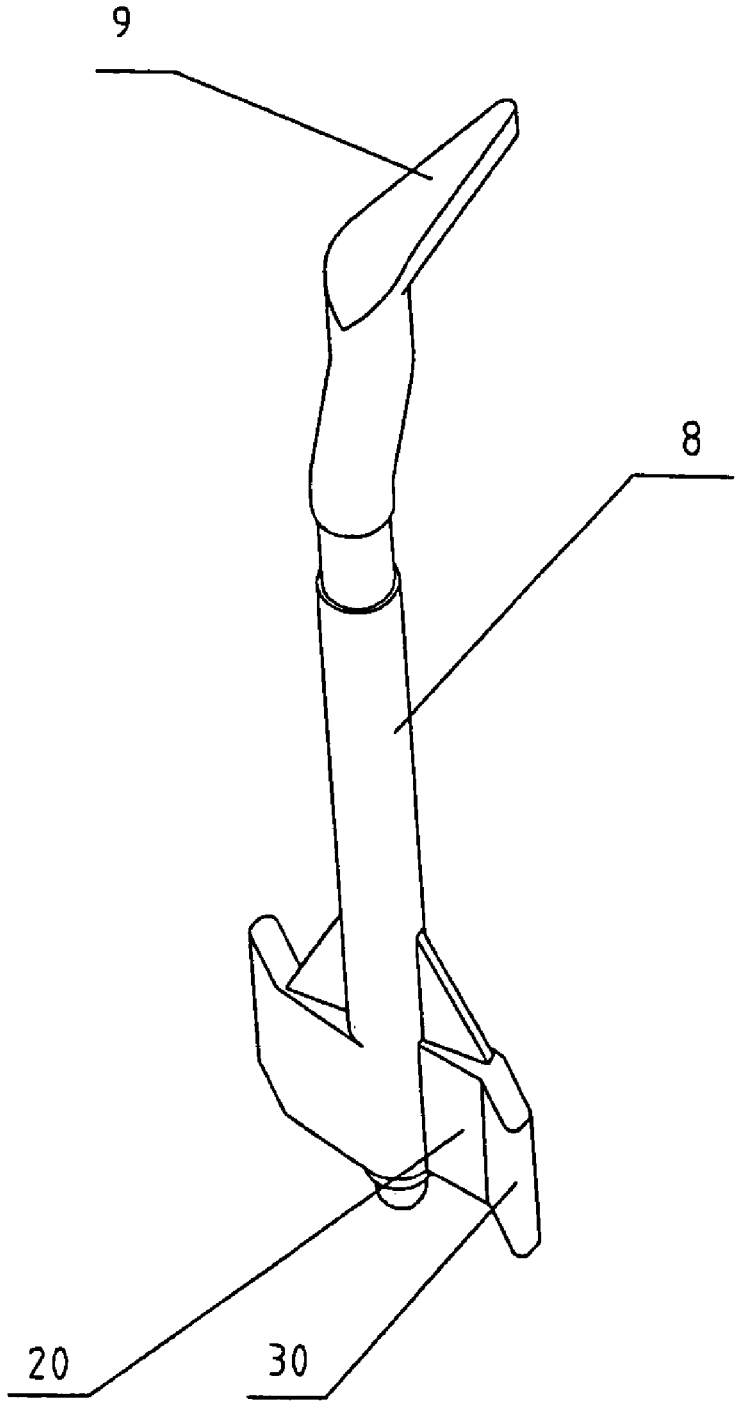
FIG. 2 is an amplified perspective view of the rotating shaft with double wing-shape pieces, a main-body rotating shaft and activating member.
Figure 3:
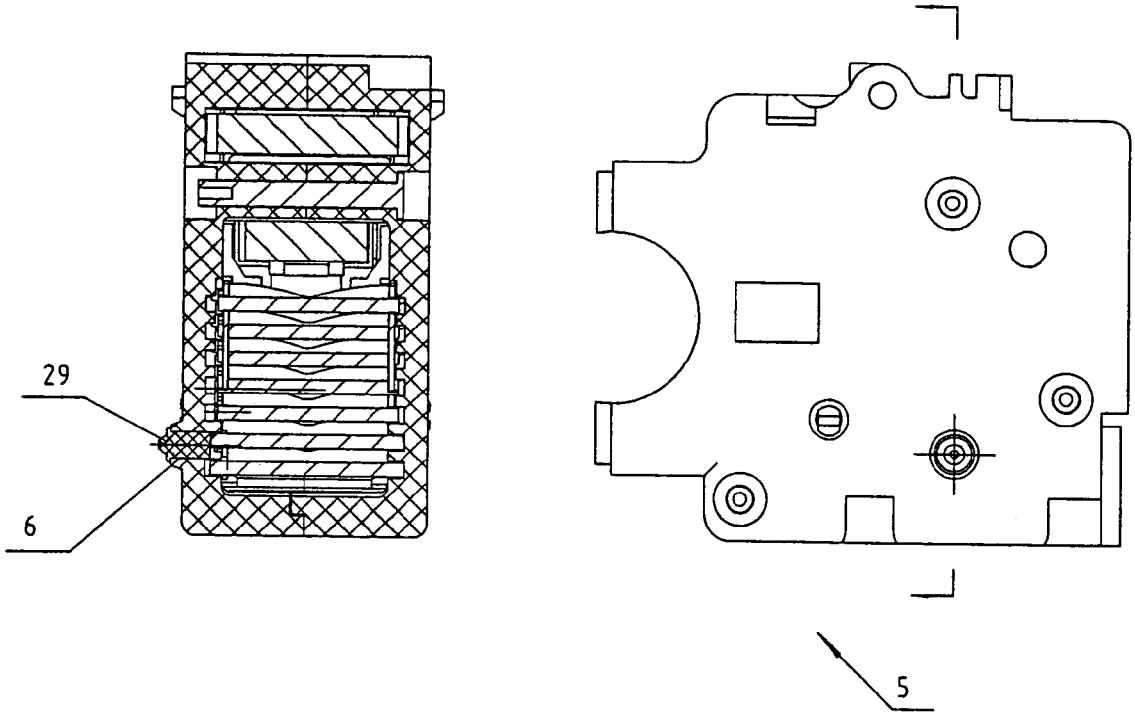
FIG. 3 is a structural schematic view of the tripping device of the sensor member and the open flange.
Figure 4:
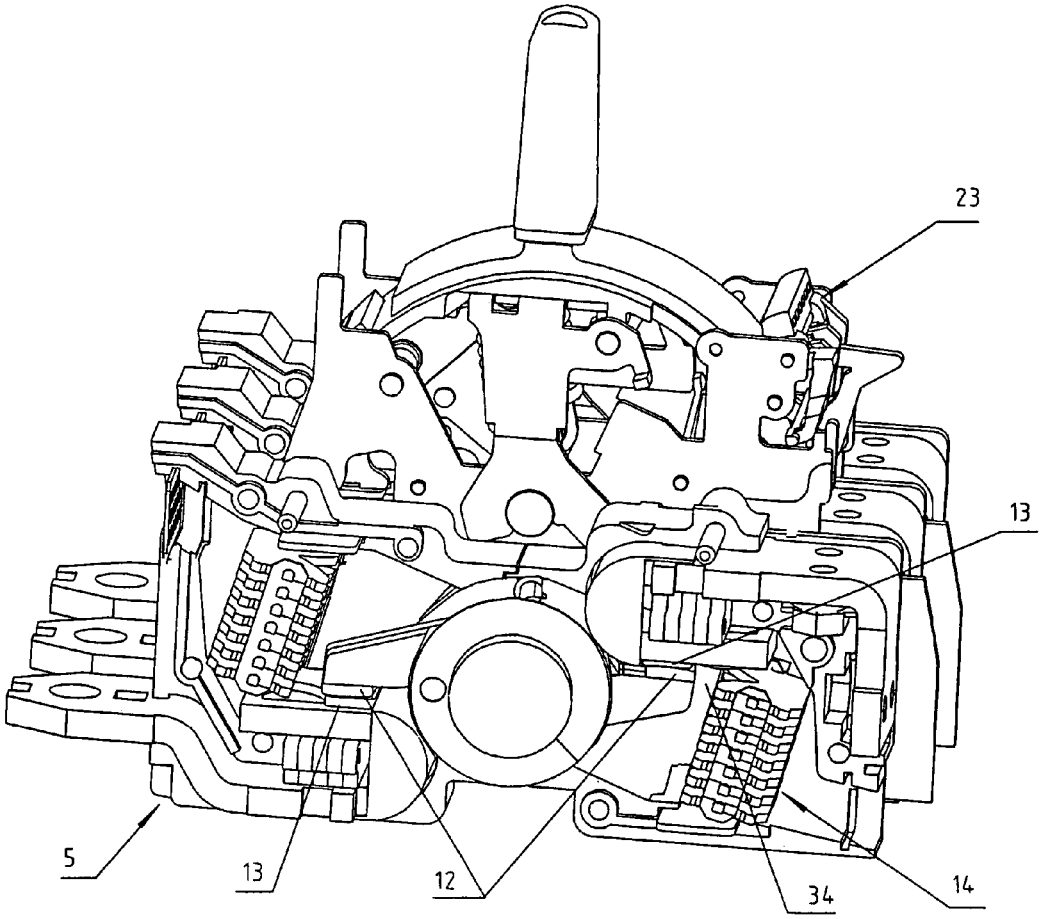
FIG. 4 is an inner structural schematic view of the multi-pole contact device.
Figure 5:
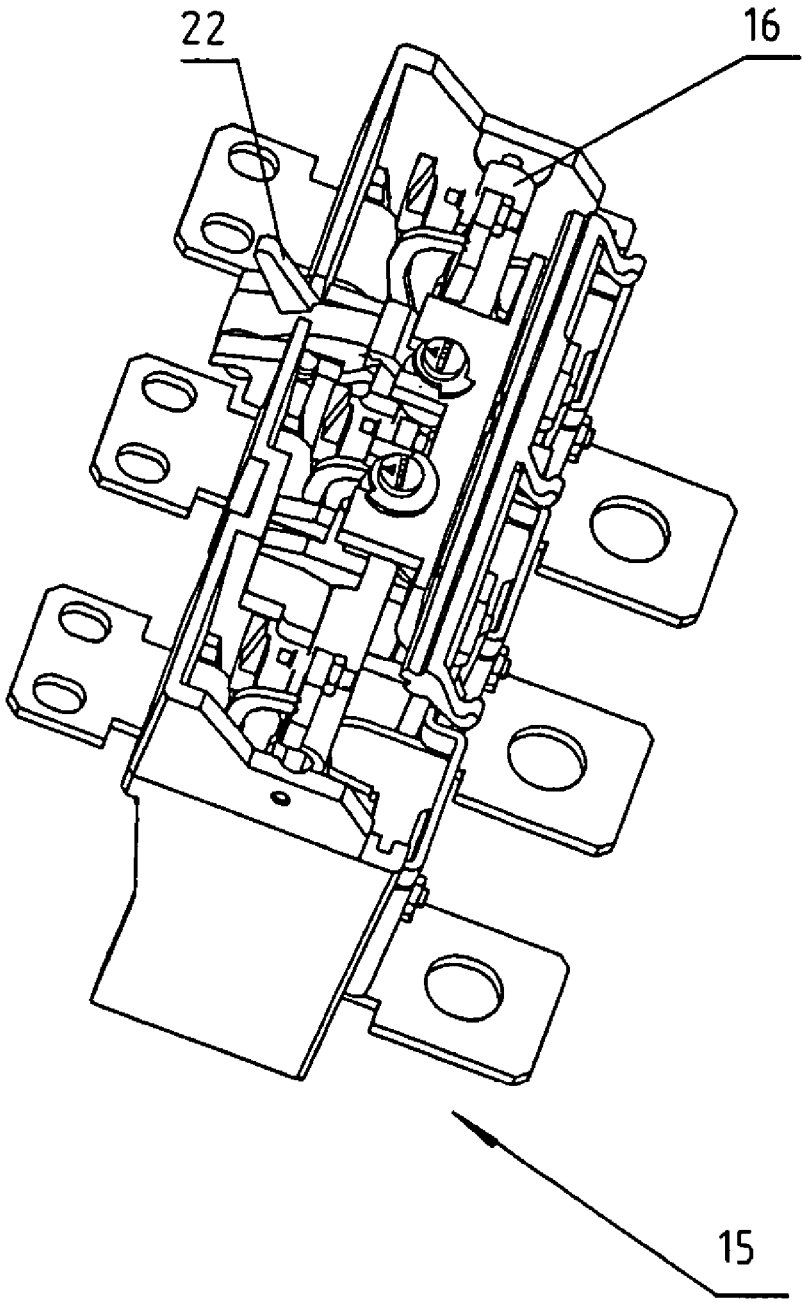
FIG. 5 is a structural schematic view of the heat energy and electromagnetic tripper.
Figure 6:
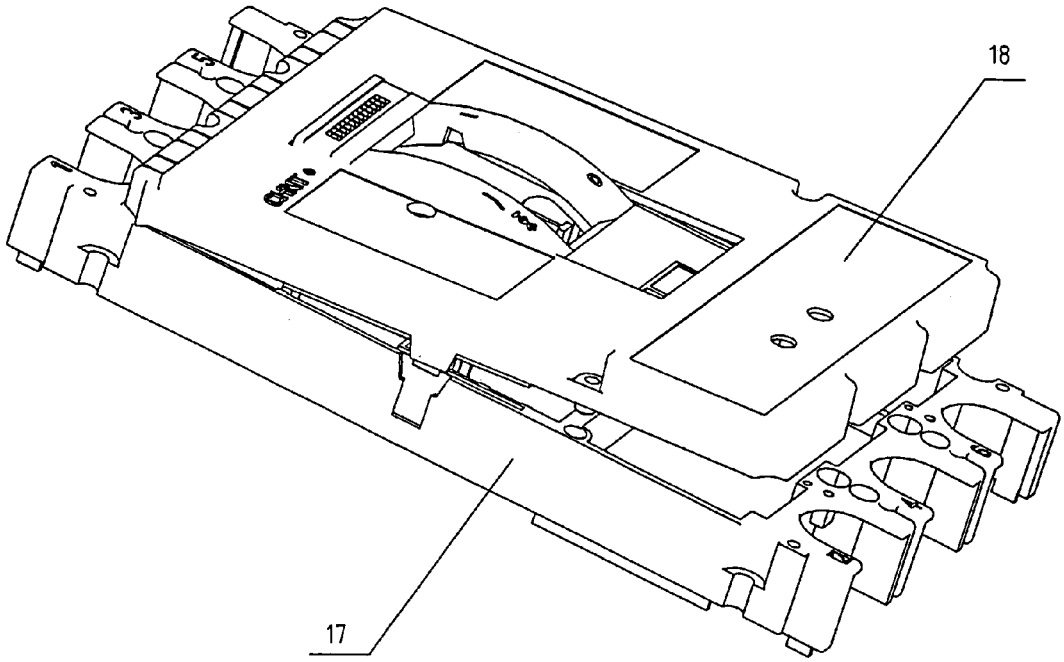
FIG. 6 is a perspective view of the base part with the casing.

Referring to FIGS. 1–6, the low-voltage circuit breaker has a housing with a bottom part 4, a base part 17 and a casing 18, and includes a triple-pole contact device 5 arranged side by side; two arc-extinguishing grid chambers 14; two pairs of contact heads 12, 13 installed in the arc-extinguishing grid chamber 14, which will be separated by the electrical repulsion force generated when the current exceeds a certain value to limit the current; an operating mechanism 1 that can open and close the contact heads; a heat energy and electromagnetic tripper 15 that can drive the operating mechanism 1 when an over-loading and/or short circuit occurs; and a rotating shaft 8, wherein the lower end of the rotating shaft 8 is disposed on a first support member 32 of the bottom part 4, the upper end of the rotating shaft 8 is pivoted on a second support member 33 which is mechanically connected to the bottom part 4. The rotating shaft 8 receives the force coming from the contact device 5 by a pair of wing-shaped pieces disposed on the bottom end thereof to generate torsion, and then drive the tripping device 23 of the operating mechanism 1 when the torsion reaches a certain value.

The top of the rotating shaft 8 provides an activating member 9. The rotating shaft 8, the activating member 9 and the wing-shaped pieces 30 are molded into an integrated structure made from plastic. The activating member 9 is disposed correspondingly to a latch 7. On both sides of the middle contact device 5, there are in-pass open flanges 6, but the contact devices 5 on the two sides only have the open flange 6 toward their inner sides. The open flange 6 is communicated with a chamber 34 where high-pressure gas can be produced and stored. The exterior surface 27 of the open flange 6 is in a cone-shape. A sensor member 29 is a cylinder with a taper or half ball head, jacketed in the open flange 6 and opposite to the wing-shaped pieces 30. Each stressed surface 20 of the wing-shaped pieces 30 is perpendicular to the axes of the open flange 6. The sensor member 29 floats in the open flange 6 and can move a certain distance in the axial direction. The sensor member 29 was confined and can only move a certain distance due to the restriction of the rotating wing-shaped pieces 30 when the sensor member 29 hits the rotating wing-shaped pieces 30. The sensor member 29 receives the airflow escaping from the open flange 6 of the contact device 5 and springs out to hit the rotating wing-shaped pieces 30 and produce a rotating force around the rotating shaft 8. This force is passed on to the activating member 9 and magnified, then the activating member hits the latch 7 quickly and makes a trip. A restoration spring 3 makes the main body of the rotating shaft 8 restore to its original position. At the same time, the sensor member 29 recovers to its original position to implement interruption when the next short circuit occurs.

Figure 7:
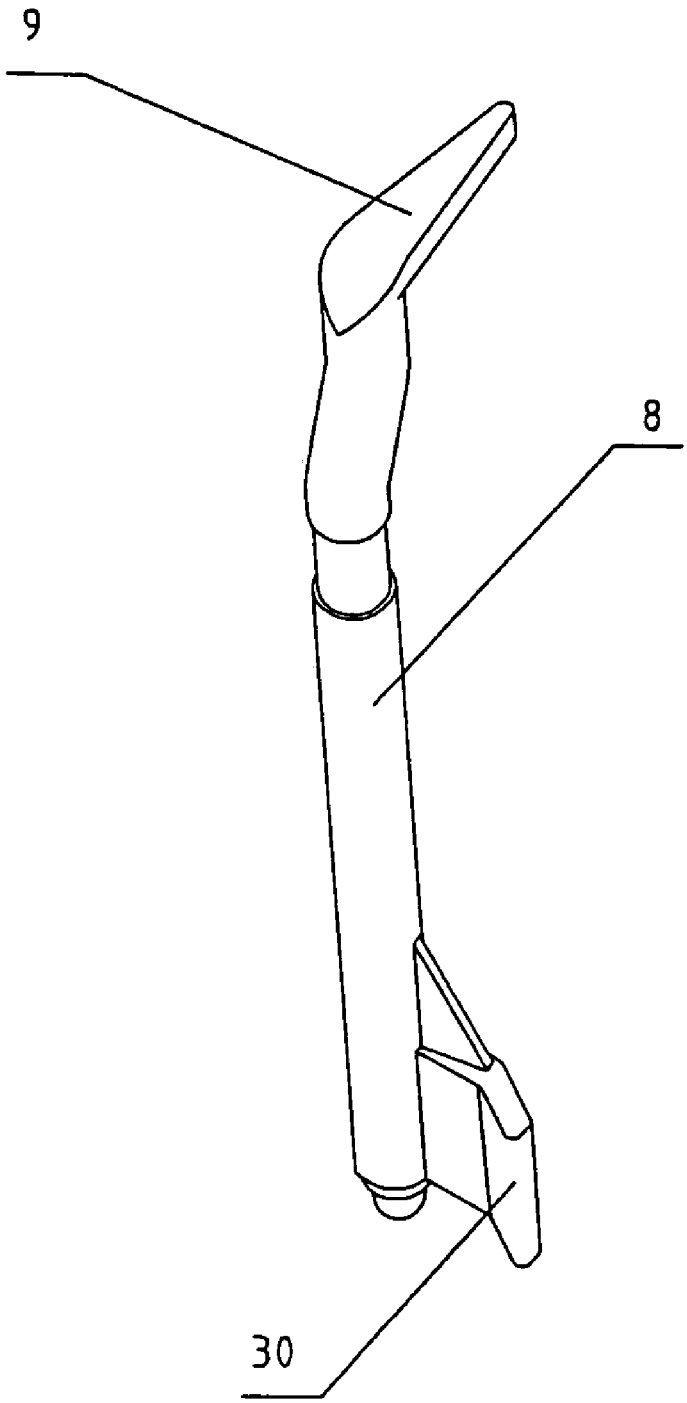
FIG. 7 is an amplified perspective view of the rotating shaft with a single wing-shape piece, main-body rotating shaft and activating member.

The embodiment showed in FIG. 7 is an improvement based on the above embodiment. The difference is that there is a single wing-shaped piece 30 disposed on the rotating shaft. In this way, each contact device 5 provides an open flange 6 at the same side correspondingly to the wing-shaped piece 30. Similarly, this structure is more suitable for the single-pole breaker.

Figure 8:
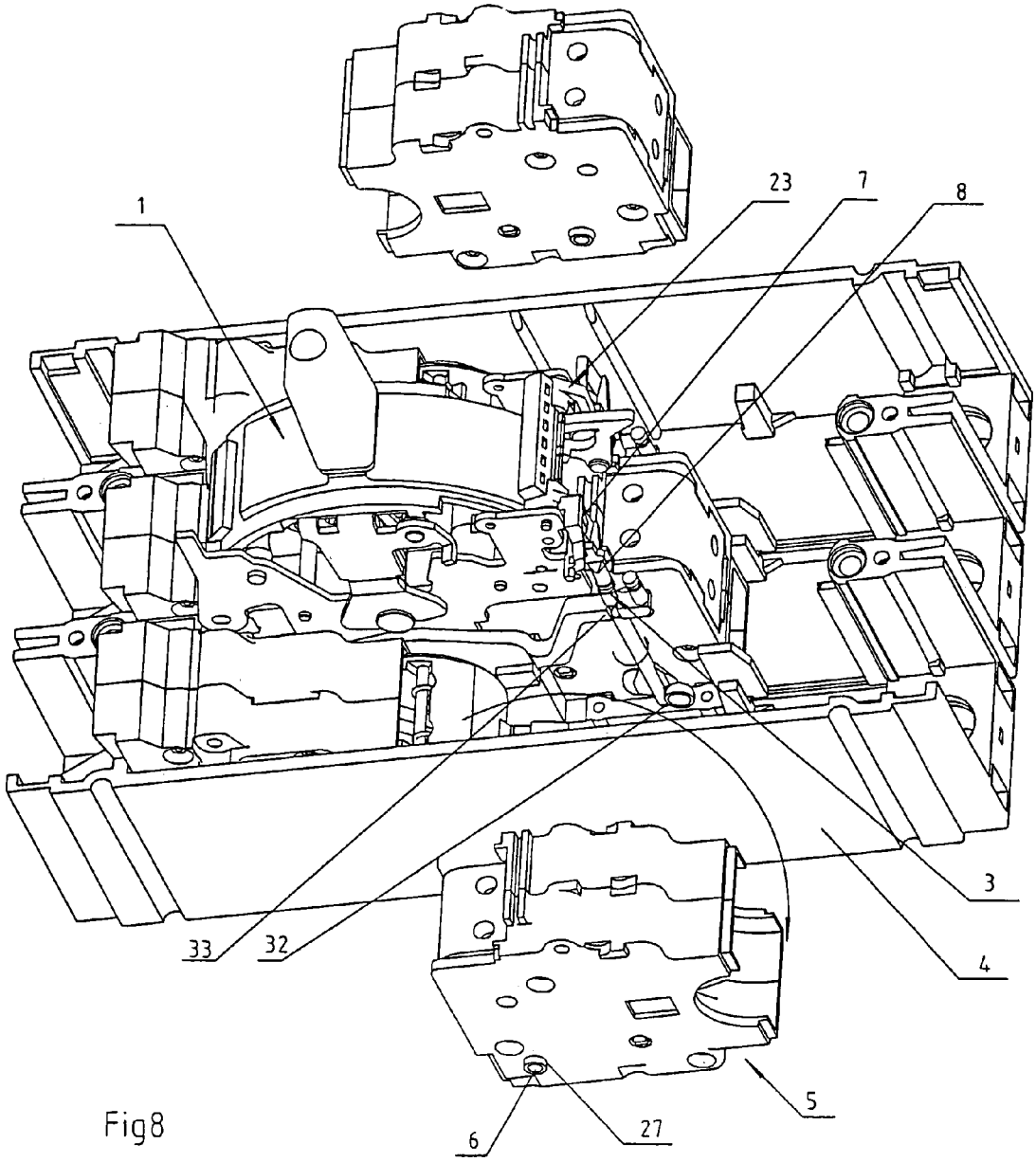
FIG. 8 is a structural schematic view of another embodiment of the low-voltage circuit breaker of the present invention.
Figure 9:
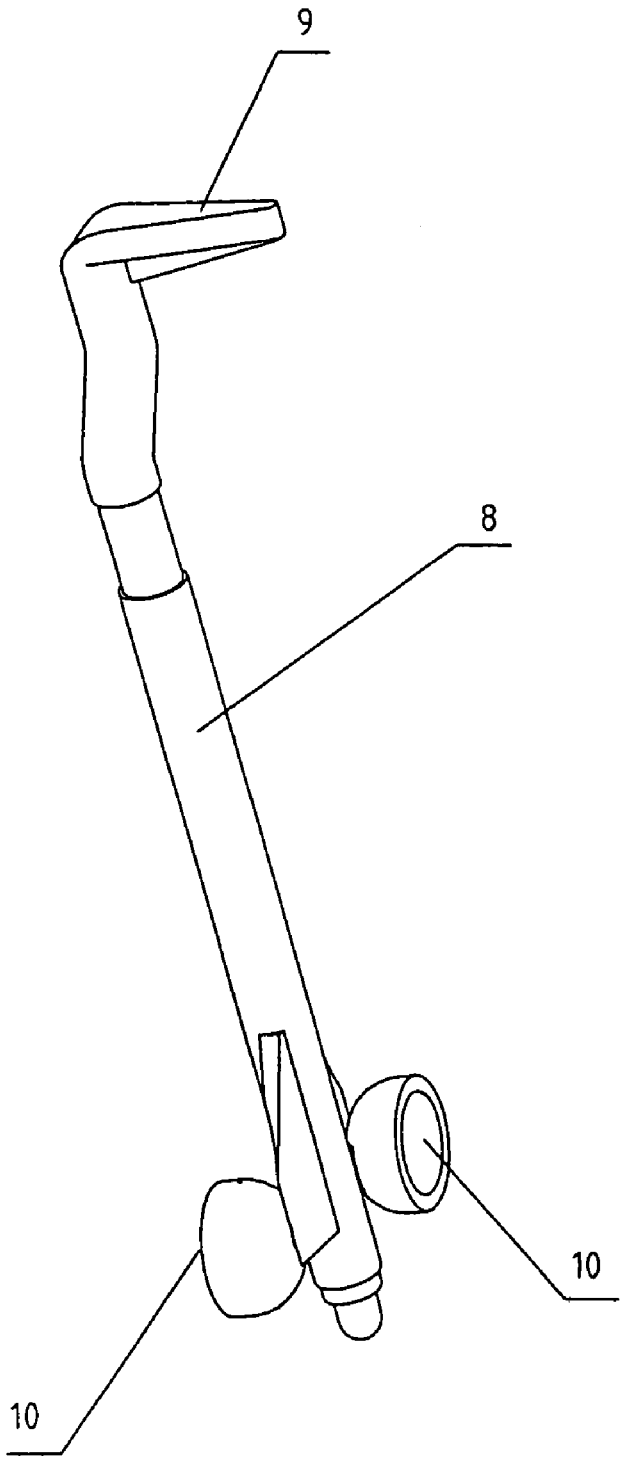
FIG. 9 is an amplified perspective view of the rotating shaft with a pair of cup-shape stressed members.

Another embodiment is showed in FIG. 8 and FIG. 9. The difference from the embodiment in FIG. 1 is that a stressed member 10 is disposed on the bottom of the rotating shaft and is a cup-shape. The exterior surface 27 of the open flange 6 of the contact device 5 is in a cylindrical shape. This cup-shaped stressed member 10 covers over the open flange 6. A matting distance between them is longer than the working distance of the stressed member 10.

Figure 10:
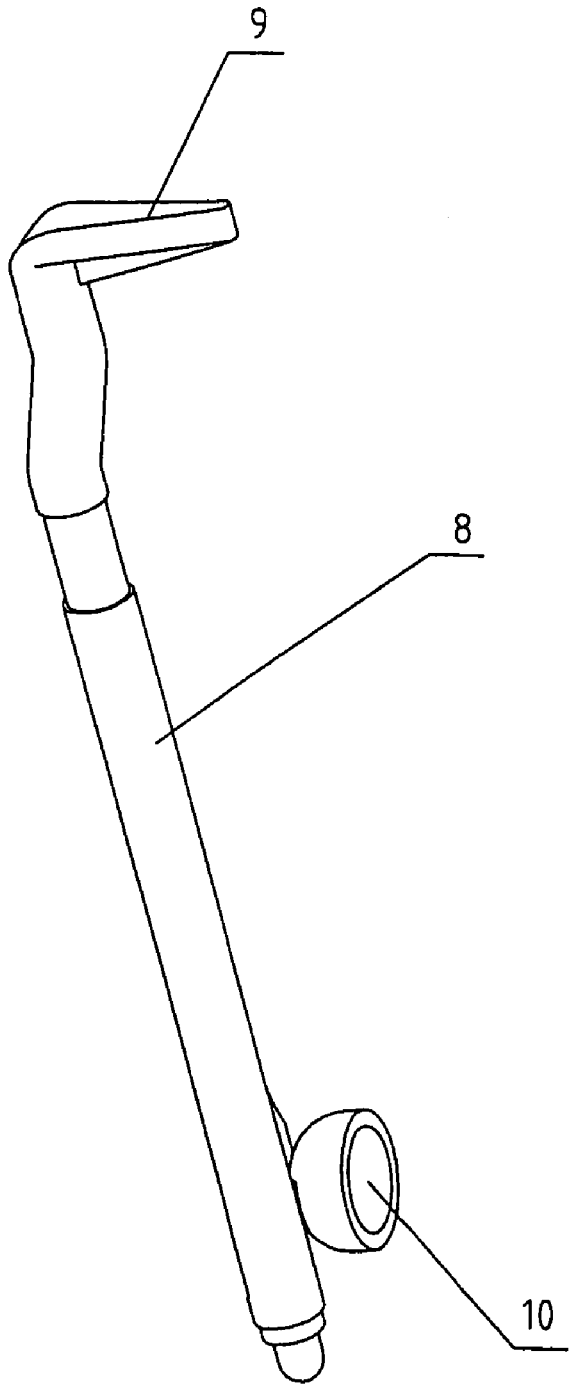
FIG. 10 is an amplified perspective view of the rotating shaft with a single cup-shape stressed member.

When the low-voltage circuit breaker is impacted by a high volume of current, the contact heads 12, 13 are separated by the repulsion force to produce an electric arc and then generate energy and impact. Most of the energy and impact are consumed by the arc-extinguishing grid therein. Some of the energy and impact escape along the open flange 6 of the contact device 5. The cup-shaped stressed members 10 on the left and right receive the over-pressure airflow escaping from the open flanges 6 of the contact devices 5 of the two adjacent poles. A rotating force around the rotating shaft is produced, which is passed on to the activating member 9 on the top of the rotating shaft and magnified to hit the latch quickly and drive the latch to rotate around the shaft anticlockwise, then make a trip. Because the rotating force is produced earlier than the force which is produced by the electromagnetic part in the heat energy and electromagnetic system, and the intermediate step in which an electromagnetic force hits the tripping device 23 by the adjusting lever 16 and the bounce latch 22 is eliminated, the low-voltage circuit breaker can break the circuit quickly, and the breaking capability is greatly enhanced. The embodiment showed in FIG. 10 is an improvement based on the above embodiment. The difference is that there is a single cup-shaped stressed member 10 of the rotating shaft. In this way, each contact device 5 provides an open flange 6 at the same side relative to the cup-shaped stressed member 10. This structure is more suitable for the breaker with a single pole.

What is claimed is:

1. A low-voltage circuit breaker with a capability of tripping quickly, having a housing with a bottom part, a base part and a casing, comprising: one-pole or multi-pole contact device with an arc-extinguishing grid chamber disposed therein, contact heads installed in the arc-extinguishing chamber adapted to be separated by the electrically operated repulsion force generated when an electrical current exceeds a certain value to limit the current; an operating mechanism that can disconnect and close the contact heads, a heat energy and electromagnetic tripper that can drive the operating mechanism when an overloading and/or short-circuit occurs; and a rotating shaft; wherein at least one side face of the contact device provides an open flange that is connected to a chamber where high-pressure gas is produced and stored; and the rotating shaft is disposed on the bottom part; the rotating shaft containing stressed members arranged correspondingly to the open flange and an activating member that is adapted to activate a tripping device of the operating mechanism to make a trip with the rotating force passed on by the stressed members.

2. The breaker according to claim 1, wherein the lower end of the rotating shaft is disposed on a first supporting member of the bottom part, and the upper end of the rotating shaft is pivoted on a second supporting member, and the second supporting member is mechanically connected to the bottom part.

3. The breaker according to claim 2, wherein the open flange of the contact device contains a floating sensor member; there being a travel clearance in the axial direction between the sensor member and the open flange; the stressed member is in a wing-shape and its stressed surface is perpendicular to the axis of the open flange.

4. The breaker according to claim 3, wherein the exterior surface of the open flange is in a cone-shape.

5. The breaker according to claim 2, wherein the exterior surface of the open flange is cylinder-shaped; the stressed member is cup-shaped and jacketed over the open flange, and a mating distance between them is longer than the working travel distance of the stressed member.

6. The breaker according to claim 1, wherein a return spring is installed on the rotating shaft.

7. The breaker according to claim 6, wherein the rotating shaft, the activating member and the stressed members are formed as an integrated structure.

* * * * *